United States Patent [19]

Cullinane

[11] Patent Number: 4,739,582

[45] Date of Patent: Apr. 26, 1988

[54] HOLDER AND ATTACHMENT BRACKET FOR FLORAL ARRANGEMENT

[76] Inventor: Dolores M. Cullinane, 8900-2nd NE., Seattle, Wash. 98115

[21] Appl. No.: 943,208

[22] Filed: Dec. 18, 1986

[51] Int. Cl.[4] ..... A01G 5/00

[52] U.S. Cl. ..... 47/41.12; 47/67

[58] Field of Search ..... 248/311.2, 213.2, 215; 211/71; 47/39, 67, 41 R, 41.12, 41.13, 41.11, 66

[56] References Cited

U.S. PATENT DOCUMENTS

| | | | |
|---|---|---|---|
| 1,566,982 | 12/1925 | Shee | 47/67 X |
| 2,157,001 | 5/1939 | Morley | 248/215 X |
| 2,536,725 | 1/1951 | Cleveland | 211/71 X |
| 2,955,794 | 10/1960 | Robbins | 248/215 X |
| 3,027,014 | 3/1962 | Lindblom | 211/71 |
| 3,477,679 | 11/1969 | Lovitz | 248/213.2 |
| 3,553,888 | 1/1971 | Daly et al. | 47/41.1 |
| 3,843,082 | 10/1974 | Garrett | 248/311.2 X |
| 4,203,175 | 5/1980 | Heine | 248/215 X |
| 4,418,496 | 12/1983 | Korstinen | 47/41.12 |

FOREIGN PATENT DOCUMENTS

| | | | |
|---|---|---|---|
| 3506407 | 8/1987 | Fed. Rep. of Germany | 47/67 |
| 178535 | 2/1962 | Sweden | 211/71 |

*Primary Examiner*—Robert A. Hafer
*Assistant Examiner*—Danton D. DeMille

[57] ABSTRACT

The subject holder and attachment bracket comprise a holder for floral arrangements and a bracket for attaching the holder to the end of a support structure. The holder is an open topped container having at least one flat side. There is a rectangular opening in the flat side near the rim, its long axis being in a horizontal plane. The bracket comprises a strut portion and a clip portion. The strut portion has first and second sides. A hook near the top of the first side engages the opening in the container and holds the container flat side against the first side. The hook and opening are shaped so that the motion of the container relative to the strut portion is highly restricted. A protuberance extends from the second side of the strut near its lower end. The clip portion extends from the top of the strut portion in a direction away from the first side of the strut. It then curves downward and back toward the strut and ends with a small curve in the opposite direction. The at rest distance between the strut and the clip portions at their point of closest proximity is less than the smallest anticipated thickness of the support structure so that the holder is held to the support structure by gravity and the force provided by the deflection of the clip.

4 Claims, 1 Drawing Sheet

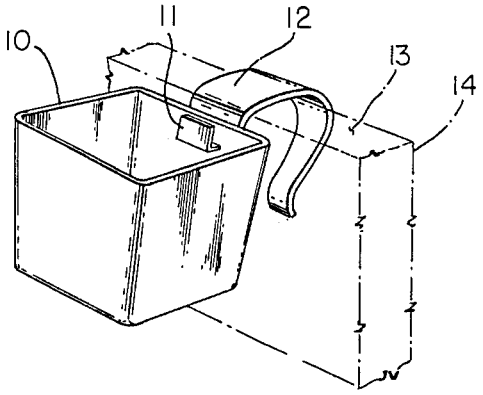
FIG. 1
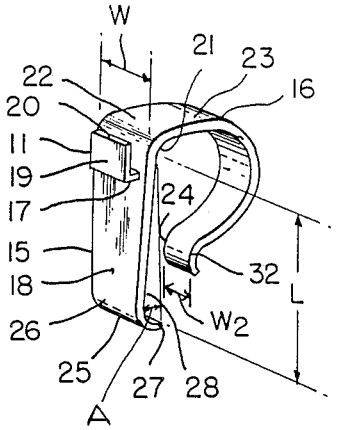
FIG. 2
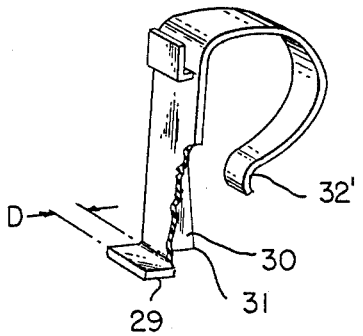
FIG. 3
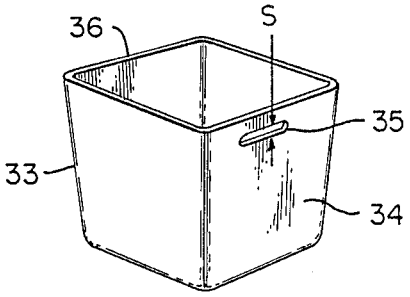
FIG. 4
FIG. 5
PRIOR ART
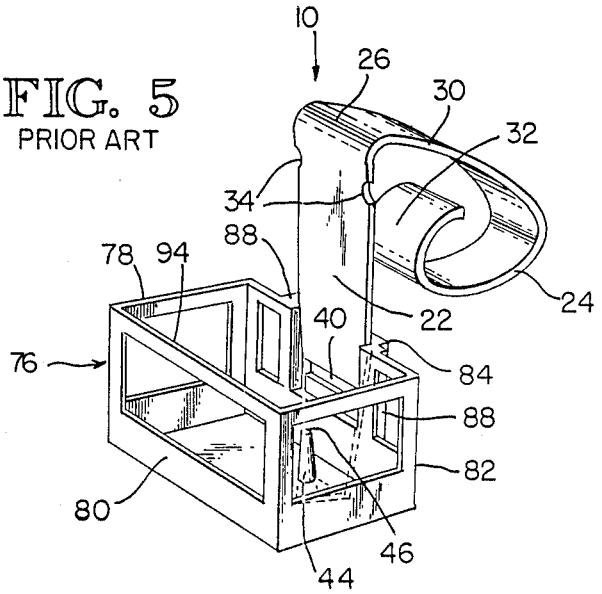

HOLDER AND ATTACHMENT BRACKET FOR FLORAL ARRANGEMENT

BACKGROUND OF THE INVENTION

1. Field of the Invention

The subject invention is in the field of vases and the like for flowers and floral arrangements. More specifically, it is in the field of vases, flower holders and the like which, in combination with attachment support or hanger apparatus, can be attached temporarily to a wall or piece of furniture such as a pew in a church. Further, it is in the field of such apparatus in which the holder and the attachment apparatus are separable and reusable individually.

2. Prior Art

The closest and most pertinent prior art in U.S. Pat. No. 4,418,496, Koistinen, Support Structure For Small Floral Arrangements. The prior art cited in that patent, particularly U.S. Pat. No. 3,027,014 by Lindblom, is also pertinent. The Kiostinen patent is directed to a structural support for a variety of articles related to floral arrangements. The support and the associated articles satisfy the known and generally recognized requirements for such apparatus. However, the versatility and level of utility of the apparatus is possible only at a cost which inhibits the extent of the use of the apparatus. Therefore, it is an objective of the subject invention to provide a floral arrangement holder and associated means for attaching it to pews and the like at a cost which will permit more general use of the invention. It is a further objective that the holder itself be useful as a separate entity with its usefulness and ornamental quality not impaired by the feature(s) which enable its satisfactory support by the attachment apparatus. Another objective is that the attachment apparatus be adaptable to function on backs and ends of pews and the like having a range of thicknesses. In this functioning it is an objective that the holder and attachment apparatus be definitely stable when in place and holding a floral arrangement. Another objective is that the attachment apparatus be as unobstrusive as practical and present minimal opportunities for inadvertent dislodging.

SUMMARY OF THE INVENTION

The invention comprises a holder for floral arrangements and a bracket for attaching the holder to the tops of ends or backs of pews and the like. The holder is a commercially available, thin-walled plastic container, modified as described below for the purposes of the invention. The container has a flat bottom, four sides and an open top having a rim formed by the top edges of the four sides. In a preferred embodiment, the container has cubical proportions; however, the sides slope slightly inwardly from top to bottom to allow stacking the containers one inside the other. A slot is provided near the top of one of the sides centered between the edges of the side (i.e. corners of the container). The slot is essentially rectangular and its long dimension is parallel to the top edge of the side. The ratio of the length to width of the rectangular dimensions of the slot is in the range of 6/1 to 10/1.

The bracket is made of resilient material, preferably plastic. It comprises a strut which, when the bracket is in place on the top of the end of a pew, for example, is oriented vertically and against the face of the end of the pew. The strut is somewhat longer than the height of the holder and its width is in the range of 1/10 to ¼ of its length. A lip extends from the lower end of the strut in the direction away from the end of the pew and essentially at right angles to the plane of the strut. Near the top of the strut a hook is provided extending in the same direction as the lip, a distance slightly greater than the thickness of the sides of the container and then upwardly for a distance essentially equal to the distance of the slot in the container side below the top edge of the side. A clip segment of the bracket extends from the top end of the strut in the direction opposite that of the lip. The clip has first, second and third curved portions. The first curved portion has an arc length of between 80° and 90°. The second curved portion has an arc length of about 180° and a radius about one-third the lenghth of the strut length. The third curved portion curves oppositely to the first and second portions and has an arc length of about 90° and a radius in the range of ¼ to ½ inch. The clip arcs away from and then back toward the strut like the handle on a pitcher. However, the distance between the strut and the clip at their point of closest proximity is in the range of ¾ of an inch to 1¼ inches. This point of closest proximity is also near the lengthwise midpoint of the strut.

On the side of the strut which faces the end surface of the pew or the like when the bracket is installed there is a protuberance, such as a rib, which holds the strut at the an angle to the end surface, with the lower end of the strut spaced away from the end surface. The angle is essentially equal to the angle between the sides of the container and a plane normal to the bottom of the container and intersecting the juncture of the side with the bottom. The protuberance, in combination with vertical orientation of the long axis of the strut, assures that the rim of the container is essentially horizontal when the apparatus is installed.

The parts are dimensioned such that the holder/container is supported by the clip engaging the slot in the side of the container and the lip helps to stabilize the container against tipping sidewise. However, in a preferred embodiment, the dimensions of the hook and slot are such that the container is adequately stabilized by the engagement between the slot and hook and the lip is not used. In this embodiment the strut can be shorter, saving further material cost.

It can be understood from this summary that the invention meets its objectives. The holder can hold any of the full spectrum of floral arrangements for which holders of this type are intended. The costs will be lower than those for known prior art apparatus because of the relative simplicity of the holder and its attachment apparatus along with the lesser amounts of material required. The holder itself is clearly useful as a separate entity, having a flat bottom and a barely noticeable feature for adapting it to be attached to the attachment apparatus. The flexibility of the clip portion of the attachment apparatus allows its use on ends of pews and the like having a range of thicknesses. The configuration of the clip is such that it protrudes a minimal distance from the side of the pew which it contacts, lessening the chance of inadvertent dislodgement of the holder and attachment by contact with an occupant of the pew or the like.

The invention is described in more detail below, in conjunction with the attached drawings.

BRIEF DESCRIPTION OF THE DRAWINGS

FIG. 1 is a perspective view of the subject invention.

FIG. 2 is a perspective view of the attachment portion of the subject invention.

FIG. 3 is a partly sectioned perspective view of an alternate embodiment of the attachment apparatus.

FIG. 4 is a perspective view of the holder of the subject invention.

FIG. 5 is a perspective view of prior art to the subject invention.

DETAILED DESCRIPTION OF THE INVENTION

Referring to FIG. 1, holder 10 is held by hook 11 on attachment apparatus 12 which is clipped over the top 13 of structure 14, representative of the end of a pew or the like. Apparatus 12 is shown completely in FIG. 2. It comprises a strut portion 15, hook 11 and clip portion 16. Hook 11 comprises a lower section 17, oriented at 90° to face 18 of the strut and perpendicular to the long axis of the strut, and an upright section 19, essentially perpendicular to section 17 and extending upward with its top edge 20 essentially level with top end 21 of the strut. Section 19 is parallel to face 18 and a distance away from it slightly greater than the thickness of the wall of the holder, described below. Clip portion 16 comprises a first curved section 22 starting at edge 20 curving away from face 18 and having an arc length in the range of 80° to 90° and an inside radius in the range of $\frac{1}{2}$ to $\frac{1}{3}$ the width W of the top edge 20. It further comprises second and third curved sections. Second section 23 curves in the same direction as the first section and has an arc length in the range of 170° to 190° and an inside radius in the range of $\frac{1}{3}$ to $\frac{1}{2}$ the length of the strut portion. The third section 24 curves in the opposite direction, has an arc length in the range of 70° to 100° and an inside radius in the range of 1/10 to $\frac{1}{4}$ the radius of the second section. The width of the clip is equal to the width W at the junction of the clip and strut portions. The clip may have a constant width or the width may taper to width $W_2$ at the end of the third section of the clip. Width $W_2$ is in the range of $\frac{1}{2}$ to $\frac{1}{4}$ of Width W.

There is a curved portion 25 at the lower end 26 of the strut forming a protuberance from the strut. It is curved in the same direction from the plane of the strut as the clip portion. The radius of portion 25 is in the range of $\frac{1}{8}$ to $\frac{1}{3}$ of width W. Tip 27 of portion 25 lies in a plane which intersects the back surface 28 of the strut at the top 21 of the strut. The angle between that plane and surface 28 is denoted A.

FIG. 3 illustrates an alternate embodiment of the attachment apparatus. In this embodiment lip 29 extends from the lower end of the strut in the same direction as the hook. It is essentially perpendicular to face 18 of the strut and extends a distance D from the face. Distance D is in the range of $\frac{1}{8}$ to $\frac{1}{4}$ of length L. In this embodiment proturberance 30 extends outward from back surface 28 of the strut. The outward extreme tip 31 of the protuberance lies in a plane which intersects the back surface 28 of the strut at the top of the strut. The angle between that plane and surface 28 is equal to the angle denoted A.

In both embodiments, FIGS. 2 and 3, the points 32 and 32' of closest proximity of the clip portion to the strut portion are at a distance from the back surface of the strut in the range of $\frac{3}{4}$ of an inch to $1\frac{1}{4}$ inches. The material from which the clip is made allows deformation of the clip to increase this dimension to as much as $2\frac{1}{2}$ inches. These points of closest proximity are essentially opposite the lengthwise mid-points of the struts. The second face of the strut faces the outer surface of the end of the pew or the like and the clip contacts the inner surface of the end.

The holder of the subject invention is illustrated in FIG. 4. It comprises a thin-walled plastic, commercially available, open-topped container 33 having essentially cubical proportions in this embodiment. The container can be of any appropriate size and shape provided it has at least one flat surface such as side 34 of the subject container, the side having a thickness of 1/32 of an inch and width and length no less than those of the attachment bracket. There is a slot 35 in side 34. The slot is a distance S below rim 36 and centered in side 34 with its long sides parallel to rim 36. The slot is 6 to 10 times its width. The length is $1\frac{1}{4}$ to $1\frac{1}{2}$ times the width W of hook 11. This extra length allows the side to distort enough to permit the container to be installed on the hook with the opening surrounding the first section of the hook. The width is slightly greater than the thickness of the first section of hook 11.

The sides of the container are sloped inward from top to bottom; i.e. the container is tapered to allow the containers to be stacked. The angle between side 34 and a plane perpendicular to the plane of the rim 36 and intersecting the juncture of side 34 with the bottom of its container is essentially equal to the angle denoted A. This assures that the rim of the container is horizontal when it is installed on the bracket and the strut is positioned on a vertical surface and vertically in plan view.

FIG. 5 illustrates the known prior art closest to the subject invention. It will be clear to those skilled in the art that, based on the differences in design complexities and material requirements between this prior art and the subject invention, that this subject invention will be appreciably less expensive to manufacture than the prior art concept shown, assuming comparable sizing and material selection. Therefore, the subject invention can be recognized as meeting one of its prime objectives. Further, there is complete access to the installed container, permitting it to hold any of the full spectrum of floral arrangements known to be used in such holders. The holder itself is clearly useful as a separate entity with its flat bottom and unobtrusive adaptation to being attached to the bracket, i.e. the opening in one of its sides. The bracket, being flexible, can readily fit on the ends of pews and the like in a range of thicknesses. Also, the bracket extends only a minimal distance into the occupant space of the pew or the like, minimizing chances for inadvertent dislodgement of the holder and bracket.

Preferred embodiments of the subject invention are described herein. However, it will be understood by those skilled in the art that other embodiments and variations and modifications of those described are possible within the scope of the subject invention. For example, whereas in the embodiments described the holder is stabilized against sidewise swinging relative to the bracket because an essentially horizontal portion of the hook is surrounded by an essentially horizontal opening in the holder, it is possible within the scope of the invention that the stabilization can be effected by an essentially vertical portion of a hook engaging an essentially vertical opening in the holder. Accordingly, the scope of the subject invention is limited only by the appended claims.

What is claimed is:

1. A holder and attachment bracket for attaching floral arrangements to the top of the end of a support structure said end having an outer surface and an inner surface, said bracket comprising:

a strut portion and a clip portion said strut portion having:

a first face, a second face, a first length, a long axis, a width W, a top end, a lower end, said top end being perpendicular to said long axis, said first and second faces being parallel, said strut portion further comprising:

a hook and a protuberance, said hook extending from said first face and comprising a first portion and a second portion, said first portion having a first thickness and being located a first distance from said top and being perpendicular to said first face and parallel to said top, said second portion having a second thickness and being perpendicular to said first portion end extending toward said top for a distance essentially equal to said first distance and being essentially parallel to said first face and spaced a second distance away from a second distance away from said first face, said protuberance protruding from said second face near said lower end and having a tip, said tip having means extending to a plane which intersects said second face at said top end, said plane being at an angle A with said second face, said clip portion being integral with said strut portion and further comprising first, second and third curved portions, said first curved portion curving away from said first face in the direction of said second face and having an arc length of between 80° and 90° and an inside radius between $\frac{1}{8}$ and $\frac{1}{3}$ of said width W, said second curved portion continuing the curve of said first portion, having an arc length between 170° and 190° and an inside radius between one-third and one-half of said length of said strut portion, said third curved portion curving oppositely to said first and second curved portions and having an arc length of between 80 and 100 degrees and an inside radius range of 1/10 to $\frac{1}{4}$ of said inside radius of said second curved portion, said holder including a container having a height and comprising:

a bottom, and at least one flat side, said height being greater than said first length, said at least one flat side having a top and an opening, said opening having a second length, a second width and a side, said side being said first distance from said top and parallel to it, second length being in the range of $1\frac{1}{4}$ to $1\frac{1}{2}$ times said first width, said second width being in the range of 1.1 and 1.2 times said first thickness, whereby said container is attached to said bracket by inserting said hook through said opening until said opening surrounds said first portion of said hook and said at least one flat side is against said first face, and said container and bracket are installed on the top of said end of said support structure by holding said protuberance from said second face against said outer surface with said strut essentially vertical and moving said bracket downward, whereby said end of said support structure causes said points of closest proximity apart so that, because of the resilience of the clip, said clip and said strut exert forces on said outer and inner surfaces to hold said bracket and holder in place on said support structure.

2. A floral arrangement and an attachment bracket for attaching said holder to a support structure, said support structure having a top, an outward surface and in inward surface, said bracket comprising:

a strut portion and a clip portion said strut portion having a top end, a lower end, a first face, a second face, a long axis, a length and a width W and further comprising a hook and a protuberance, said hook having a first segment and a second segment, said first segment being a first distance from said top end and extending perpendicularly to said first face a second distance, said second segment extending from said first segment toward said top end and being parallel to said first face, said second segment extending a second distance from said first segment, said protuberance extending from said second face near said lower end and having a tip, said tip having means extending to a plane which intersects said top end of said second face, said plane being at first angle with said second face, said clip portion being integral with said bracket portion and having first, second and third curved portions, said first curved portion extending from said top end and curving away from said first face and having an arc length between 80° and 90° and and inside radius in the range of $\frac{1}{8}$ to $\frac{1}{3}$ of said width W, said second curved portion curving in the same direction as said first curved portion and having an arc length between 170° and 190° and an inside radius in the range of $\frac{1}{3}$ to 178 of said length of said strut portion, said third curved portion curving in a direction opposite to the direction of said first and second curved portions and having an arc length between 70° and 100° and an inside radius in the range of 1/10 to $\frac{1}{4}$ of said inside radius of said second curved portion, said holder being a container having an open top, a rim, a height, a bottom and at least one flat side, said at least one flat side having an opening having a length, a width and a lengthwise centerline, said lenthwise centerline being parallel to said rim and said first distance from said rim, said at least one flat side being at an acute angle to said rim, said angle being 90° minus said first angle, whereby said holder is attached to said hook by insertion of said hook through said opening until said at least one flat side contacts said first face and said bracket is attached to said support structure by placing said tip against said outward surface with said long axis vertical and moving said second curved portion toward said top whereby said third curved portion engages said inward surface to attach said holder to said support structure.

3. The holder and attachment bracket of claim 1 in which said bracket further comprises a lip extending perpendicularly from said first face of said strut portion at said lower end to engage said bottom of said container when said holder is installed on said bracket.

4. The floral arrangement holder and attachment bracket of claim 2 in which said bracket further comprises a lip extending perpendicularly from said first face of said strut portion at said lower end to engage said bottom when said holder is installed on said bracket.

* * * * *